US008850744B2

(12) United States Patent
Bauman et al.

(10) Patent No.: US 8,850,744 B2
(45) Date of Patent: Oct. 7, 2014

(54) HARDWARE FOR A HINGED LIGHT PANEL

(71) Applicant: Truth Hardware Corporation, Owatonna, MN (US)

(72) Inventors: Leonard P. Bauman, Byron, MN (US); Yoshikazu Nakanishi, Tokyo (JP); Manabu Shimoji, Tokyo (JP); Naokazu Suzuki, Tokyo (JP)

(73) Assignee: Truth Hardware Corporation, Owatonna, MN (US)

( * ) Notice: Subject to any disclaimer, the term of this patent is extended or adjusted under 35 U.S.C. 154(b) by 0 days.

(21) Appl. No.: 13/842,494

(22) Filed: Mar. 15, 2013

(65) Prior Publication Data

US 2014/0026489 A1 Jan. 30, 2014

Related U.S. Application Data

(60) Provisional application No. 61/649,170, filed on May 18, 2012.

(51) Int. Cl.

| | |
|---|---|
| ***E05B 65/06*** | (2006.01) |
| ***E05C 9/18*** | (2006.01) |
| ***E06B 3/36*** | (2006.01) |
| *E05B 1/00* | (2006.01) |
| *E05C 9/02* | (2006.01) |

(52) U.S. Cl.

CPC ..... *E05C 9/1841* (2013.01); *E05B 2001/0076* (2013.01); *E05C 9/1875* (2013.01); *E06B 3/36* (2013.01); *E05C 9/02* (2013.01)

USPC ..... 49/395; 49/394; 292/32; 292/33; 292/34; 292/44; 292/45; 292/46

(58) Field of Classification Search

CPC . E05B 65/0007; E05B 63/0004; E05B 65/06; E05B 59/00; E05B 63/0056; E05C 9/063

USPC ..... 49/394, 395; 70/107–111; 292/32, 162, 292/244, DIG. 21

See application file for complete search history.

(56) References Cited

U.S. PATENT DOCUMENTS 4,882,877 A * 11/1989 Guetle et al. ..... 49/506
6,282,929 B1 * 9/2001 Eller et al. ..... 70/109

(Continued)

OTHER PUBLICATIONS http://www.neumadoors.com/products_vented_features.html—Ventered Sidelight Patio Doors Design Features.*

*Primary Examiner* — Katherine Mitchell
*Assistant Examiner* — Marcus Menezes
(74) *Attorney, Agent, or Firm* — Patterson Thuente Pedersen, P.A.

(57) ABSTRACT

A securing mechanism for a hinged sidelight panel. The securing mechanism includes a center latch bolt for latching the hinged sidelight panel and remote locking mechanisms for locking the hinged sidelight panel. A single lever handle is used to selectively retract the remote locking mechanisms and the latch bolt. At a first orientation of the handle, both the remote locking mechanisms and the latch bolt are engaged. At a second orientation of the handle, the latch bolt remains engaged, but the remote locking mechanisms retracted. At a third orientation, both the remote locking mechanisms and the latch bolt are disengaged. The orientation of the handle informs an observer whether the locks are engaged. In one embodiment, the full rotation is about 90°, enabling the use of longer lever handles without interference from door frames.

16 Claims, 11 Drawing Sheets

(56) References Cited

U.S. PATENT DOCUMENTS

| | | | | |
|---|---|---|---|---|
| 6,971,686 | B2 * | 12/2005 | Becken | 292/39 |
| 7,946,080 | B2 * | 5/2011 | Ellerton et al. | 49/395 |
| 8,146,392 | B2 * | 4/2012 | Topfer | 70/107 |
| 2002/0104339 | A1 * | 8/2002 | Saner | 70/108 |
| 2005/0092042 | A1 * | 5/2005 | Constantinou et al. | 70/107 |
| 2005/0166647 | A1 * | 8/2005 | Walls et al. | 70/107 |
| 2006/0196236 | A1 * | 9/2006 | Gruenendahl | 70/107 |
| 2010/0327610 | A1 * | 12/2010 | Nakanishi et al. | 292/162 |

* cited by examiner

HARDWARE FOR A HINGED LIGHT PANEL

RELATED APPLICATIONS

This application claims the benefit of U.S. Provisional Application No. 61/649,170, entitled HARDWARE FOR A HINGED SIDELIGHT PANEL, filed May 18, 2012, said application hereby fully incorporated herein by reference.

FIELD OF THE INVENTION

The disclosed invention relates generally to doors with sidelight panels. More specifically, the invention relates latching hardware for hinged sidelight panels.

BACKGROUND

Hinged or "operable" sidelight panels have been limited in availability because the available hardware has undesirable aspects. Hardware options range from casement operators mounted to the frame to cam type handles or thumb turns. The aesthetically "out of place" appearance of these systems have deterred door manufacturers from offering operable side lights, particularly for high end door systems.

Certain hinged patio doors are intended as entry doors and have many extra features such as a deadbolt and anti slam devices that are not needed on a side light application. Other hinged sidelight panels feature mechanisms driven by a thumb turn knob that travels through approximately 135° rotation to activate the remote locks and latch bolt. The obtuse angle of rotation required for activation prevents the use of a longer handle to drive the mechanism because the handle will interfere with the door frame when rotated from horizontal.

What is needed is a hinged sidelight panel having hardware that performs the latching and securing operation within a smaller angle of rotation and without unneeded features associated with entry doors.

SUMMARY OF THE INVENTION

In various embodiments of the invention, a sidelight securing mechanism is provided that uses one handle to operate a center latch bolt as well as upper and lower remote locking mechanisms. In one embodiment, the hinged sidelight panel can be held closed by the center latch bolt only. If additional security is desired, the remote locking mechanisms can be engaged as well. The maximum angle of rotation is limited to approximately 90°, so that a lever handle (as opposed to a knob) can be used as a visual indicator to show when only the center latch bolt is engaged, or if the remote locking mechanisms are also engaged.

When the side light panel is in the closed position and the lever handle is in a first angular orientation (in one embodiment, substantially horizontal), the center latch bolt is engaged and the remote lock mechanisms are engaged. To disengage the remote lock mechanisms, the lever handle is rotated downward to a second angular orientation (in one embodiment, approximately 70° down from horizontal), leaving only the center latch bolt engaged. To open the hinged sidelight, the lever handle is rotated downward to a third angular orientation (in one embodiment, approximately 90° downward from horizontal) to fully retract the center latch bolt. The hinged sidelight panel can then be swung open and the lever handle released. In one embodiment, upon release of the lever handle, the center latch bolt is extended lever handle returns to the second angular orientation. When the lever handle is in the second angular orientation, the remote lock mechanisms remain retracted.

With the lever handle in the second angular orientation, closure can be accomplished by simply pushing the sidelight panel into the closed position. The center latch bolt is tapered and spring loaded and will automatically retract when contacting the strike plate and then engage the strike plate once the hinged sidelight panel is fully closed. In one embodiment, the lever handle remains in the second angular orientation, providing a visual indication that only the center latch bolt is engaged. The door can then be reopened by rotating the lever handle downward to the third angular orientation to release the center latch bolt.

In one embodiment, to engage the remote locking mechanisms when the hinged sidelight panel is held closed only by the latch bolt (i.e., the lever handle is in the second angular orientation), the elongated handle is rotated upward to the first angular orientation.

In an embodiment, a hinged door system for closing an opening in a structure includes a frame defining a primary door opening and a sidelight opening adjacent the primary door opening, a first primary hinged panel operably disposed in the primary door opening, and a secondary hinged panel operably disposed in the sidelight opening. A multi-point latching system on the secondary hinged panel includes a center cassette having an operating mechanism and a selectively retractable latch bolt operable with the operating mechanism, at least one remote latch mechanism spaced apart from the center cassette, the at least one remote latch mechanism including a selectively operable latch bolt, a coupler linking the at least one remote latch mechanism with the operating mechanism of the center cassette, and a rotatable lever handle operably coupled with the operating mechanism of the center cassette. When the handle is positioned in a first position, the latch bolt of the center cassette and the latch bolt of the at least one remote latch mechanism are extended to latch the secondary hinged panel in place in the sidelight opening, when the handle is positioned in a second position, the latch bolt of the at least one remote latch mechanism is retracted, and when the handle is positioned in a third position, both the latch bolts of the center cassette and the at least one remote latch mechanism are retracted to enable the secondary panel to be opened.

In a further embodiment, the second position of the handle is a first angular distance from the first position, and the third position is a second angular distance from the first position, the second angular distance being greater than the first angular distance. The first angular distance may be about 70 degrees. The second angular distance may be about 90 degrees.

In an embodiment, the multi-point latching system comprises two remote latch mechanisms.

In an embodiment the center cassette and the two remote latching mechanisms are disposed along a side margin of the secondary hinged panel opposite the hinges. One of the remote latching mechanisms may be disposed vertically above the center cassette and the other of the remote latching mechanism may be disposed vertically below the center cassette. The latch bolt of the center cassette can be spring-loaded.

In a further embodiment, a multi-point latching system includes a center cassette having an operating mechanism and a selectively retractable latch bolt operable with the operating mechanism. At least one remote latch mechanism is spaced apart from the center cassette, the at least one remote latch mechanism including a selectively operable latch bolt. A coupler links the at least one remote latch mechanism with the operating mechanism of the center cassette. A rotatable lever handle is operably coupled with the operating mechanism of the center cassette such that when the handle is positioned in a first position, the latch bolt of the center cassette and the latch bolt of the at least one remote latch mechanism are extended to latch the secondary hinged panel in place in the sidelight opening, when the handle is positioned in a second position, the latch bolt of the at least one remote latch mechanism is retracted, and when the handle is positioned in a third position, both the latch bolts of the center cassette and the at least one remote latch mechanism are retracted to enable the secondary panel to be opened.

In an embodiment, the second position of the handle is a first angular distance from the first position, and the third position is a second angular distance from the first position, the second angular distance being greater than the first angular distance. The first angular distance may be about 70 degrees, and the second angular distance may be about 90 degrees.

In an embodiment, the multi-point latching system includes two remote latch mechanisms. The center cassette and the two remote latching mechanisms can be disposed along a side margin of the secondary hinged panel opposite the hinges. One of the remote latching mechanisms can be disposed vertically above the center cassette and the other of the remote latching mechanism can be disposed vertically below the center cassette. The latch bolt of the center cassette can be spring-loaded.

BRIEF DESCRIPTION OF THE DRAWINGS

The embodiments of the present invention may be more completely understood in consideration of the following detailed description of various embodiments in connection with the accompanying drawings, in which.

Figure 1:
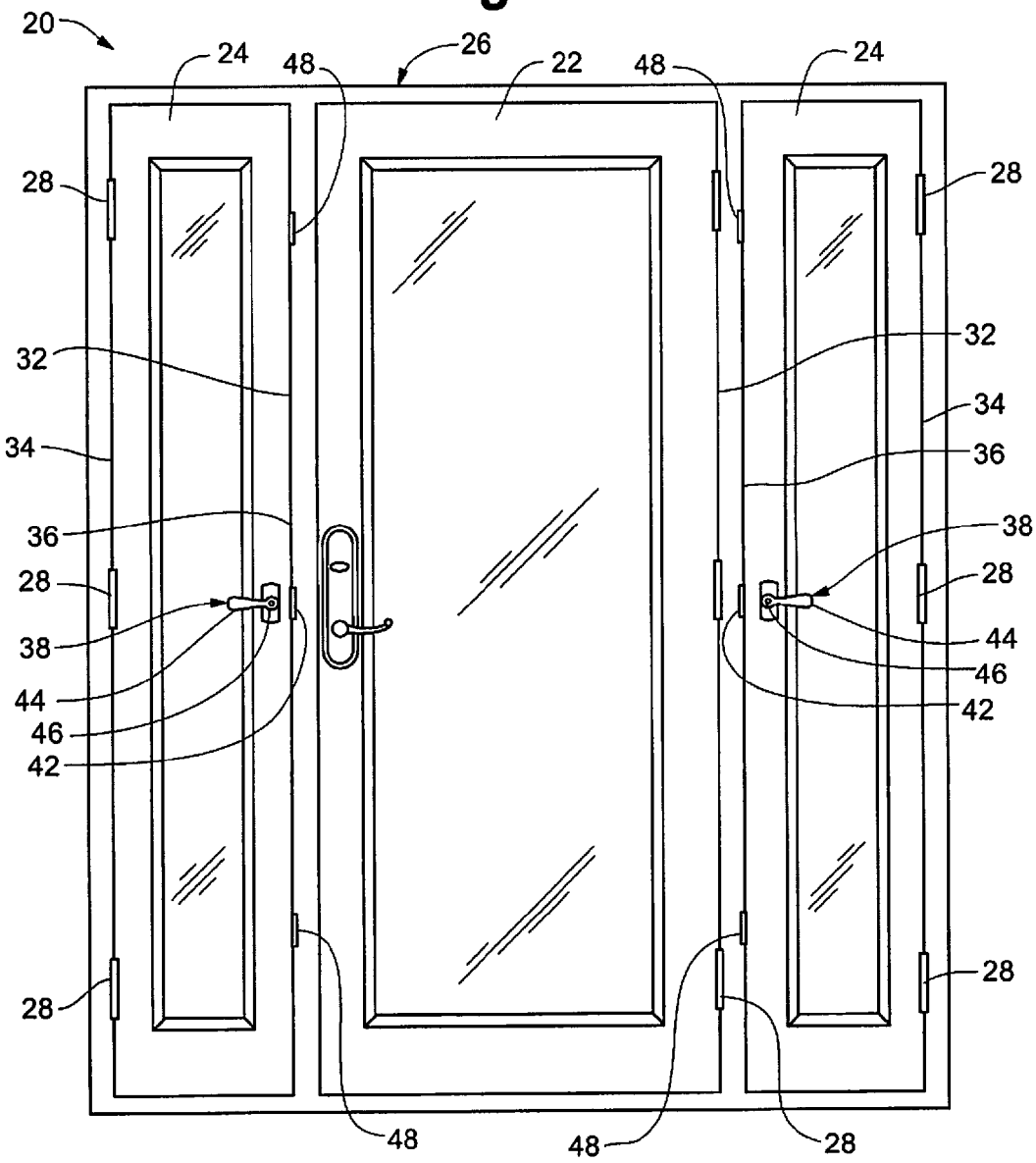
FIG. 1 is an elevation view of a patio door assembly in an embodiment of the invention.

While the present invention is amenable to various modifications and alternative forms, specifics thereof have been shown by way of example in the drawings and will be described in detail. It should be understood, however, that the intention is not to limit the present invention to the particular embodiments described. On the contrary, the intention is to cover all modifications, equivalents, and alternatives falling within the spirit and scope of the present invention.

DETAILED DESCRIPTION

Referring to FIG. 1, a patio door assembly 20 including a patio door 22 and hinged sidelight panels 24 are depicted in an embodiment of the invention. The patio door assembly 20 comprises a frame 26 to which the patio door 22 and hinged sidelight panels 24 are mounted via hinges 28, and includes interior frame members 32. Each hinged sidelight panel 24 is characterized as having a hinged edge 34 and a latching edge 36 and includes an lever handle assembly 38 mounted thereto for operation of a securing mechanism disposed within. A center strike plate 42 is positioned on each interior frame member 32 proximate the corresponding lever handle assembly 38 for engagement with the mechanism of the corresponding hinged sidelight panel 24. Each lever handle assembly 38 includes an lever handle 44 that extends to one side of a rotation axis 46 and away from the corresponding center strike plate 42. In one embodiment, remote strike plates 48 are located on each hinged sidelight panel 24 above and below the center strike 42 plate for supplemental engagement with the mechanism.

Figure 2:
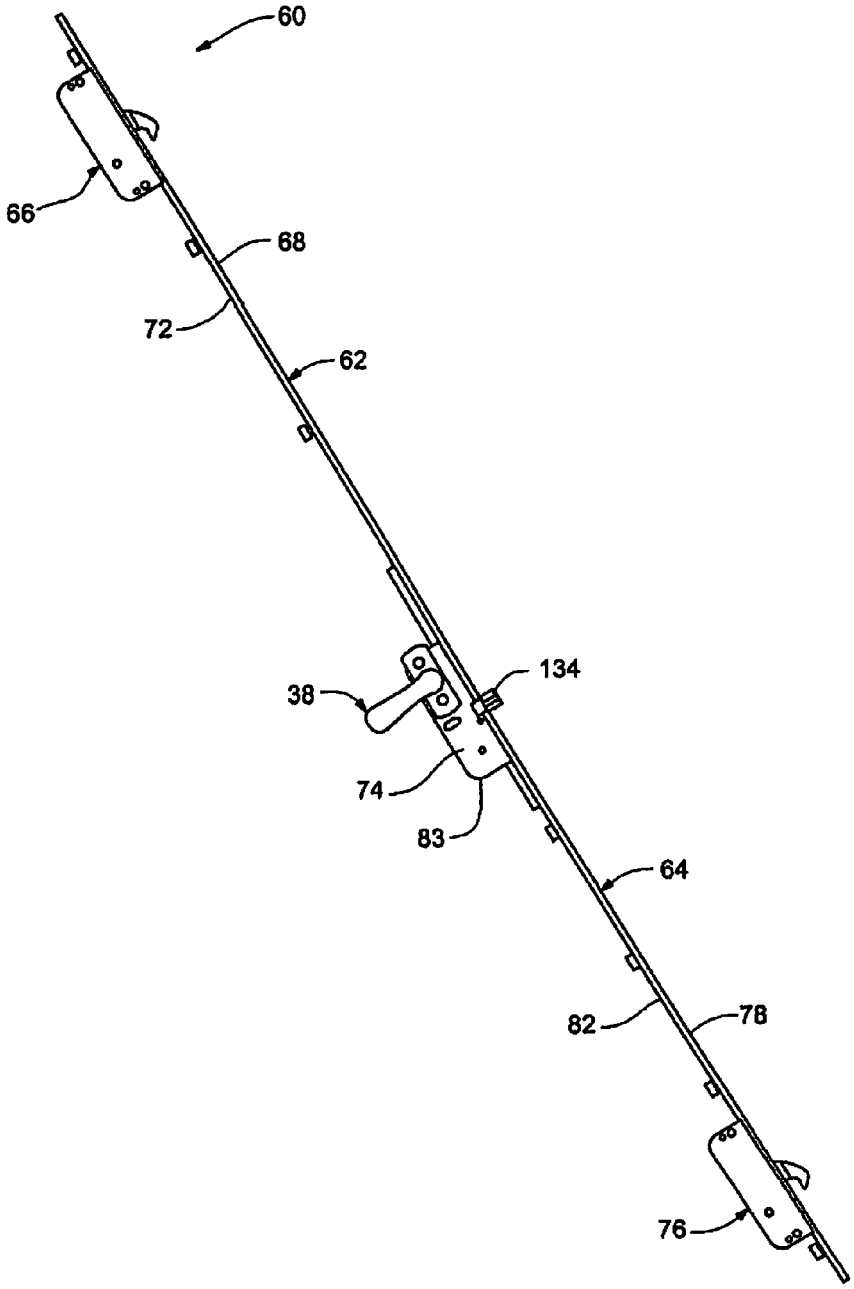
FIG. 2 is a perspective view of a sidelight securing mechanism in an embodiment of the invention.

Referring to FIG. 2, a sidelight securing mechanism 60 is depicted in an embodiment of the invention. In one embodiment, the sidelight securing mechanism 60 includes an upper bar assembly 62 and a lower bar assembly 64 connected together and disposed in grooves and pockets along the latching edge 36 of the sidelight panel 24. The upper bar assembly 62 comprises a remote locking mechanism 66 attached to a faceplate 68 and tie bar 72. The lower bar assembly 64 comprises a center cassette 74 and a remote locking mechanism 76 connected by a faceplate 78 and a tie bar 82. The center cassette 74 drives the tie bars 72 and 82 in the upper and lower bar assemblies 62 and 64. The center cassette 74 also includes a center cassette housing 83 and retractable latch bolt 134.

Figure 3:
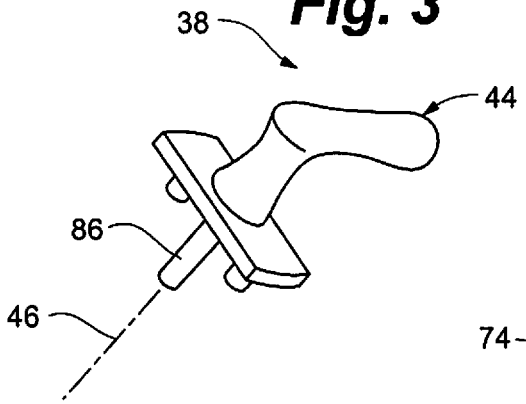
FIG. 3 is a perspective view of an lever handle assembly in an embodiment of the invention.
Figure 4:
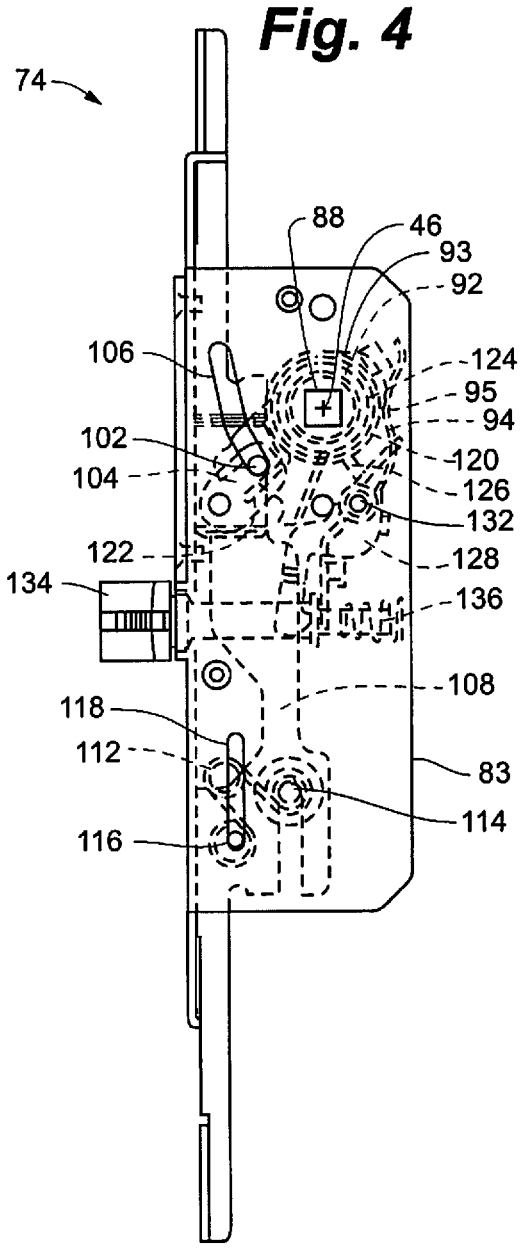
FIG. 4 is an elevation view of the center cassette of FIG. 2 in an embodiment of the invention.
Figure 5:
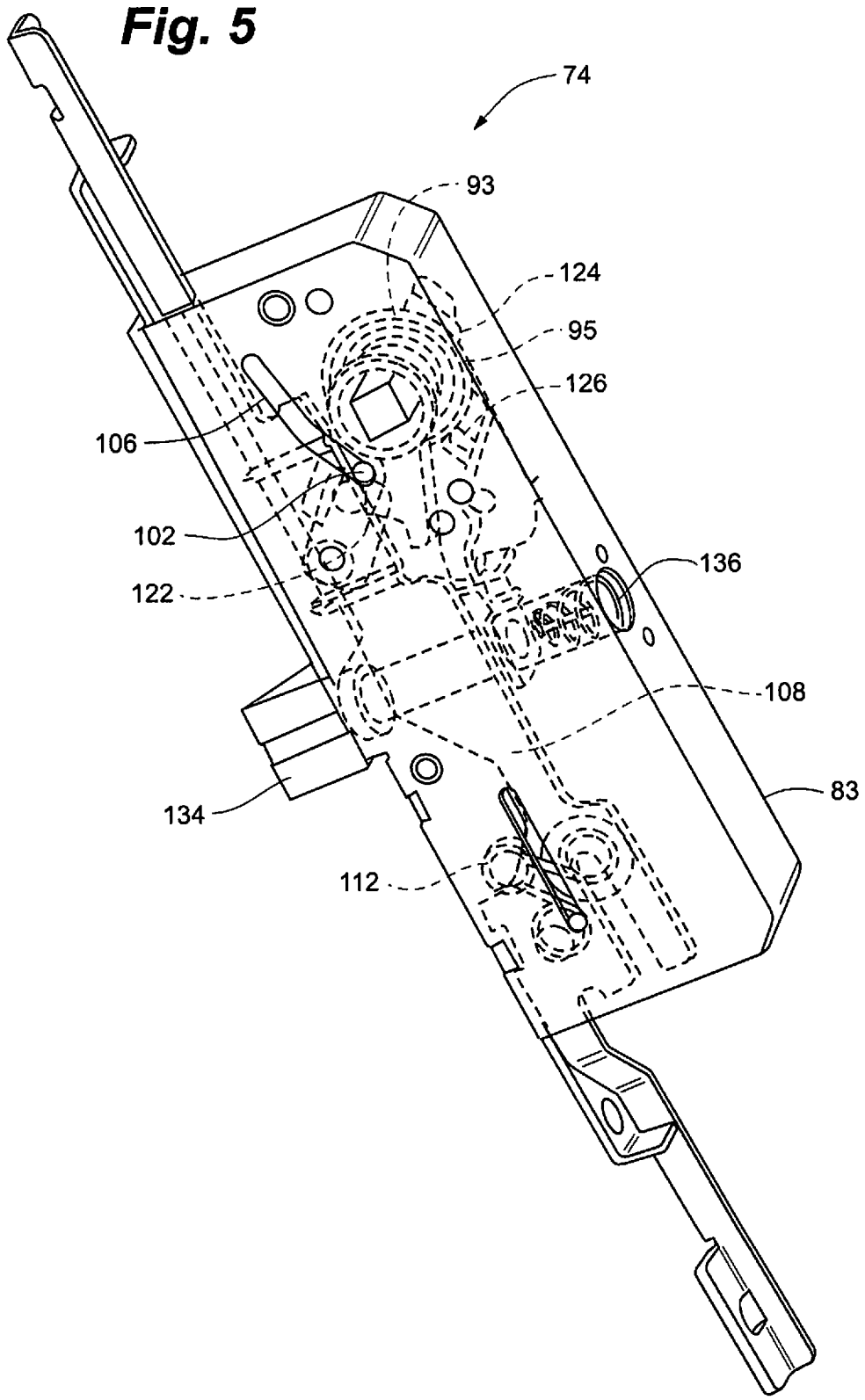
FIGS. 5 and 6 are perspective views of the center cassette of FIG. 4 in when the latch bolt and the remote locking mechanisms are fully engaged in an embodiment of the invention.
Figure 6:
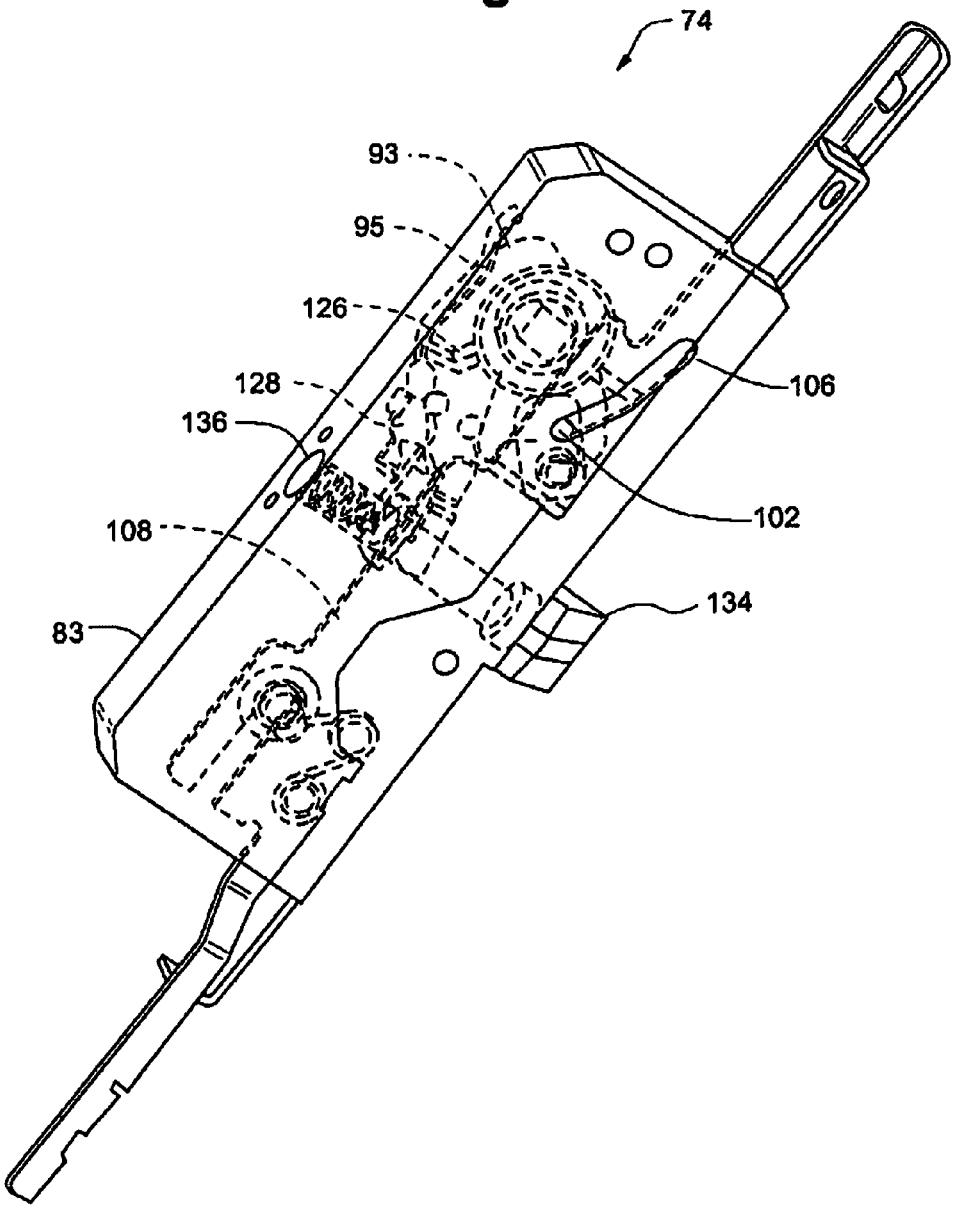
Figure 7:
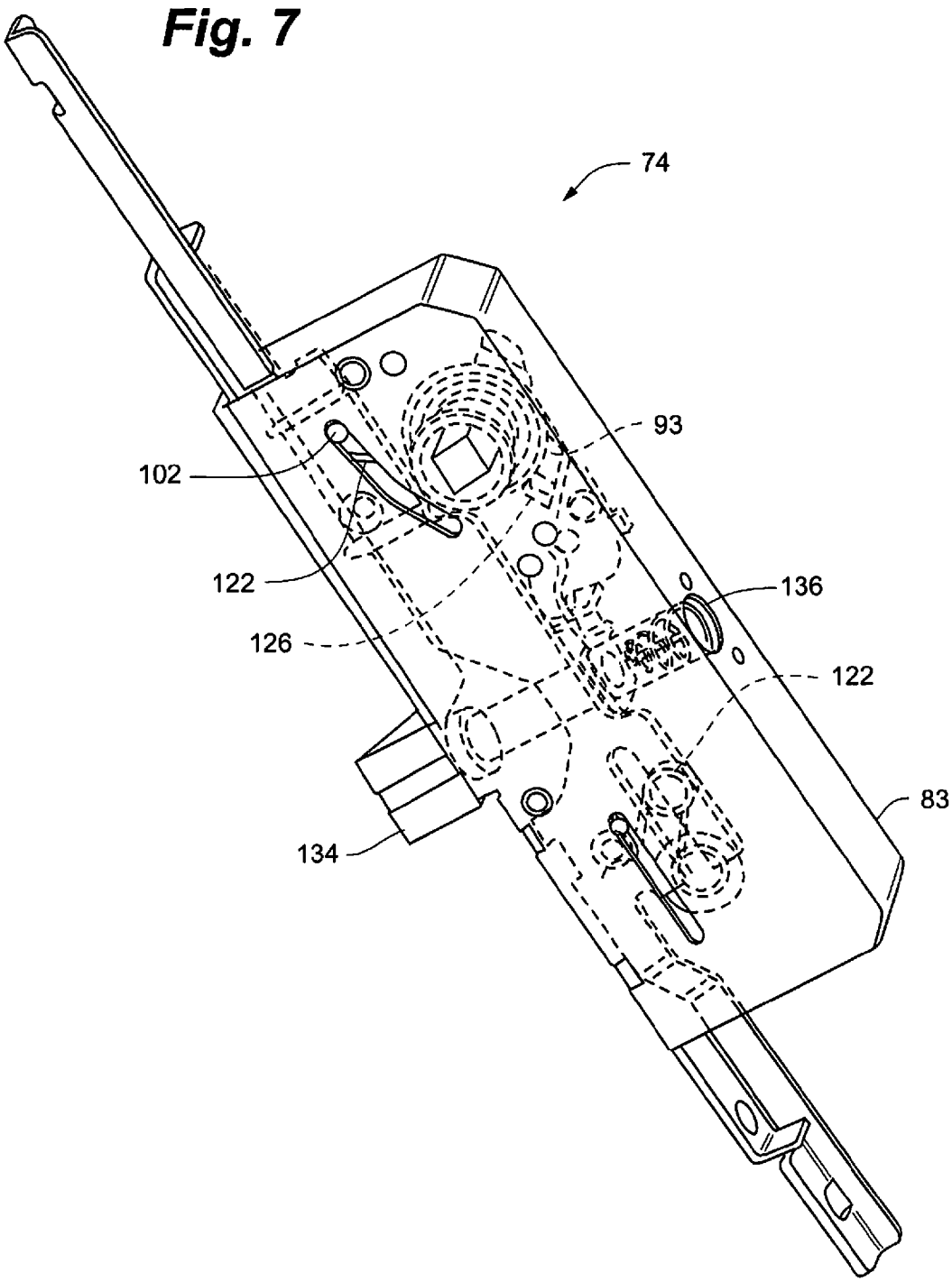
FIG. 7 is a perspective view of the center cassette of FIG. 4 when the remote locking mechanisms are retracted and the latch bolt is engaged.
Figure 8:
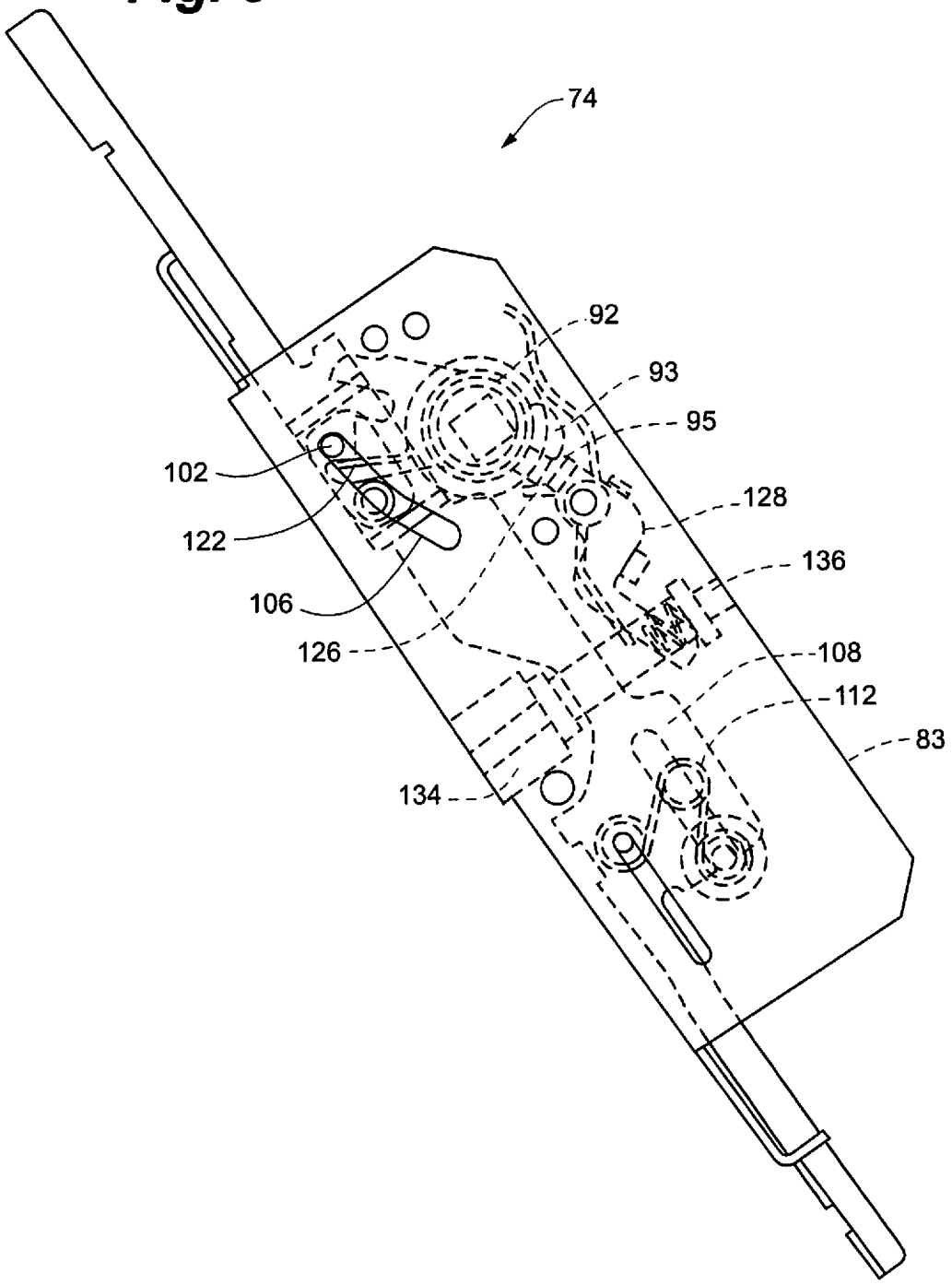
FIG. 8 is a perspective view of the center cassette of FIG. 4 when the latch bolt and the remote locking mechanisms are disengaged in an embodiment of the invention.

Referring to FIGS. 3 and 4, the lever handle assembly 38 and the center cassette 74 driven thereby are depicted in an embodiment of the invention. In one embodiment, the lever handle assembly 38 is mounted to the inside face of the hinged sidelight panel 24 and includes a square or polygonal shaft 86 that extends into the hinged sidelight panel 24 for driving the center cassette 74. The square shaft 86 is concentric with the rotation axis 46 and engages a square or polygonal aperture 88 in the center cassette 74 for driving a rotating crank 92 of the center cassette 74. The rotating crank 92 includes a lobe cam 93 having a leading face 95. A crank flat detent spring 94 is coupled to the center cassette housing 83 and arranged to apply a friction force against the lobe cam 93 on the rotating crank 92.

The rotating crank 92 is slidingly engaged with a link plate pin 102 that extends from a link plate 104, the link plate pin 102 being captured for slidable operation within a first slot 106 that is formed on the center cassette housing 83. The link plate 104 is pivotally attached to an operation bar 108 that is mounted within the center cassette housing 83 and adapted to slide vertically within the center cassette housing 83. A detent spring 112 is anchored on one end to a bushing 114 that is fixed to and extends between opposing walls of the center cassette housing 83. The other end of the detent spring 112 is anchored to a spring pin 116 that extends from the operation bar 108, the spring pin 116 being captured for slidable operation within a second slot 118 formed on the center cassette housing 83.

In one embodiment, a crank spring 120 is operatively coupled with and is coiled around the rotating crank 92. The crank spring 120 is loosely coupled to the rotating crank 92. A first leg 122 of the crank spring 120 is in contact and rides along with the link plate pin 102. The crank spring 120 includes a leg 124 on the other end, the leg 124 extending radially outward in a direction away from the axis of rotation 46 and is adapted to rotate along with the rotating crank 92.

The leading face 95 of the lobe cam 93 is adapted to engage an upper extremity 126 of a kick plate 128 upon rotation through a first angle of rotation θ1. The kick plate 128 includes a pivot 132 that is operatively coupled to the center cassette housing 83. The kick plate 128 is further adapted to engage a latch bolt 134 that extends laterally through the center cassette housing 83. A cone spring 136 is positioned to engage with the latch bolt 134 as the latch bolt 134 is retracted into the center cassette housing 83.

Referring to FIGS. 5 through 8, operation of the central cassette 74 is described. In operation, the square or polygonal shaft 86 of the lever handle assembly 38 drives the rotating crank 92 when the lever handle 44 is rotated about the rotation axis 46. The rotating crank 92 drives the link plate pin 102 along the first slot 106 in the center cassette housing 83, and the link plate pin 102 drives the link plate 104 which in turn drives the operation bar 108. When the operation bar 108 has moved approximately half way through its travel, the detent spring 112 exerts a force that pushes the operation bar 108 to a fully extended position of travel. The operation bar 108 drives the tie bars 72 and 82 that drive the remote upper and lower remote locking mechanisms 66 and 76 in an action that, as described below, retracts the remote locking mechanisms 66 and 76.

The lobe cam 93 on the rotating crank 92 is situated with respect to the upper extremity 126 of the kick plate 128 so that when the link plate pin 102 has traveled to the full limit of the first slot 106 in the center cassette housing 83, the leading face 95 of the lobe cam 93 has also traveled substantially through the first angle of rotation θ1 and is engaged or nearly engaged with the upper extremity 126. At this point, the rotating crank 92 can rotate an additional angle of rotation θ2. The leading face 95 of the lobe cam 93 exerts a force on the upper extremity 126 of the kick plate 128 which acts to rotate the kick plate 128 about its pivot, which in turn retracts the latch bolt 134 into the center cassette housing 83. Retraction of latch bolt 134 causes compression of the cone spring 136, which exerts a bias force on the latch bolt 134. When the lever handle 44 is released, the bias force exerted by the cone spring 136 causes the latch bolt 134 to extend outward into an engagement position.

The crank spring 120 rides freely with the rotating crank 92 through the first angle of rotation θ1. Upon entering the additional angle of rotation θ2, the first leg 122 of the crank spring 120 engages with the link plate pin 102 which is at the extreme point within the slot 106. The second leg 124, however, engages the leading face 95 of the lobe cam 93 and so continues travel with the leading face 95, which puts the crank spring 120 in tension. Thus, upon release of the lever handle 44, the rotating crank 92 and lever handle 44 are returned back though the additional angle of rotation θ2 to rest at the first angle of rotation θ1.

When the lever handle 44 is returned to the horizontal position, the rotating crank 92 rotates in the opposite direction, driving the link plate pin 102, the link plate 104, and the operation bar 108 in the opposite direction. This action drives the tie bars 72 and 82 for extension of the remote locking mechanisms 66 and 76. As the operation bar 108 moves approximately half through its travel, the detent spring 112 passes though an over-center condition to apply a force to assist the rotating crank 92 in returning the operation bar 108. The operation bar 108 in turn pulls on the link plate 104 and link plate pin 102, trapping the link plate pin against the lower end of the first slot 106. The link plate pin 102 then holds the rotating crank 92 in the return position. The rotating crank 92 holds the handle 44 in the horizontal position, assisted by the friction force exerted by the crank flat detent spring 94.

Figure 9A:
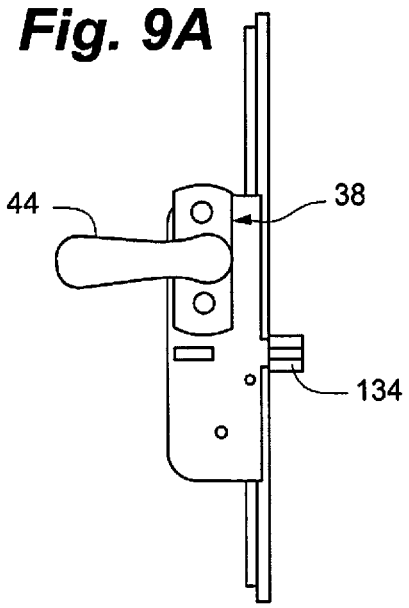
FIGS. 9A through 9C are elevation views of the elongated handle assembly of FIG. 3 in various states of operation in an embodiment of the invention.
Figure 9B:
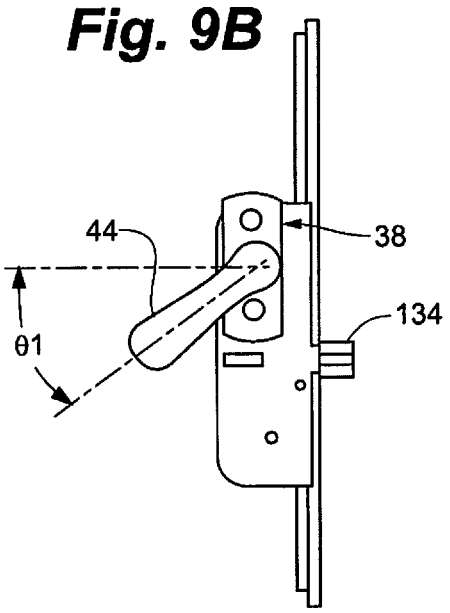
Figure 9C:
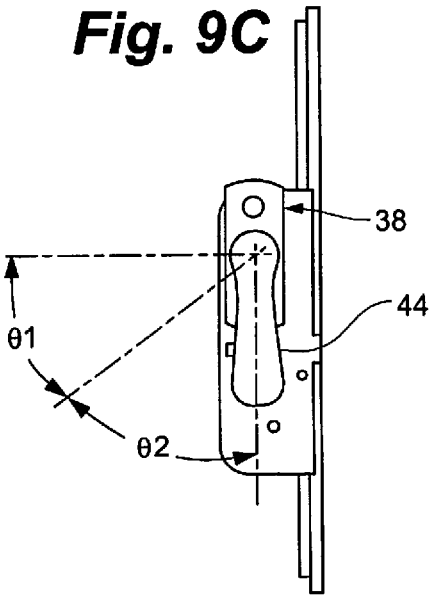

Referring to FIGS. 9A through 9C, the angular orientation of the lever handle 44 is depicted in an embodiment of the invention. In one embodiment, when the latch bolt 134 and remote locking mechanisms 66 and 76 are engaged, the lever handle 44 is oriented substantially horizontally (FIG. 9A). When the latch bolt 134 is engaged with the remote locking mechanisms 66 and 76 retracted, the lever handle 44 is oriented at the first angle of rotation θ1 (FIG. 9B). When the latch bolt 134 and remote locking mechanisms 66, 76 are all retracted, the lever handle 44 is oriented at an angle of rotation (θ1+θ2), where θ2 is the additional angle of rotation (FIG. 9C). It is noted that the original horizontal orientation of FIG. 9A is arbitrary, and other initial orientations can also be utilized. In one example and non-limiting embodiment, the first angle of rotation θ1 is approximately 70° and the additional angle of rotation θ2 is approximately 20°.

Functionally, the position of the lever handle 44 provides a visual indication of the status of the sidelight securing mechanism. That is, when the lever handle is in the first orientation (e.g., with the lever handle 44 substantially horizontal), an observer knows that the latch bolt 134 and the remote locking mechanisms 66 and 76 are fully engaged. If the lever handle 44 is in the second orientation (e.g., FIG. 9B), the observer knows that only the latch bolt 134 is engaged but not the remote locking mechanisms 66 and 76. Furthermore, for embodiments where the total rotational travel (θ1+θ2) is approximately 90°, use of lever handles 44 that are longer than the thumb knobs of the prior art is enabled because the interior frame members 32 do not interfere with their operation. The longer lever handle 44 enables easier visual confirmation of the status of the sidelight securing mechanism 20.

Figure 10:
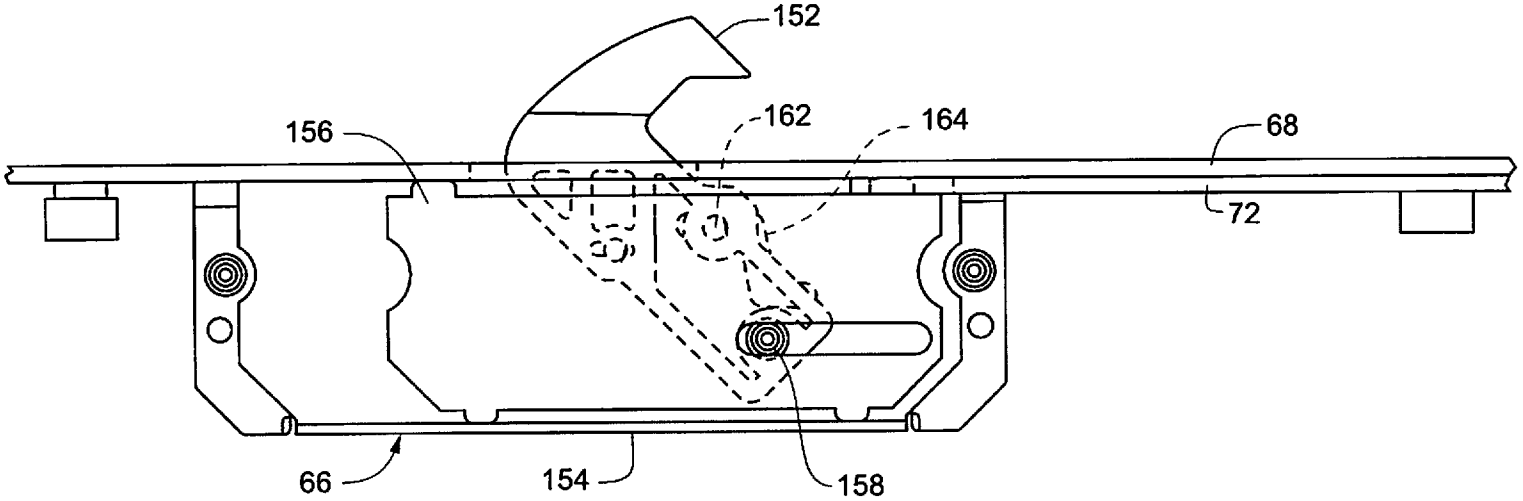
FIGS. 10 and 11 are plan views of a remote locking mechanism in an embodiment of the invention.
Figure 11:
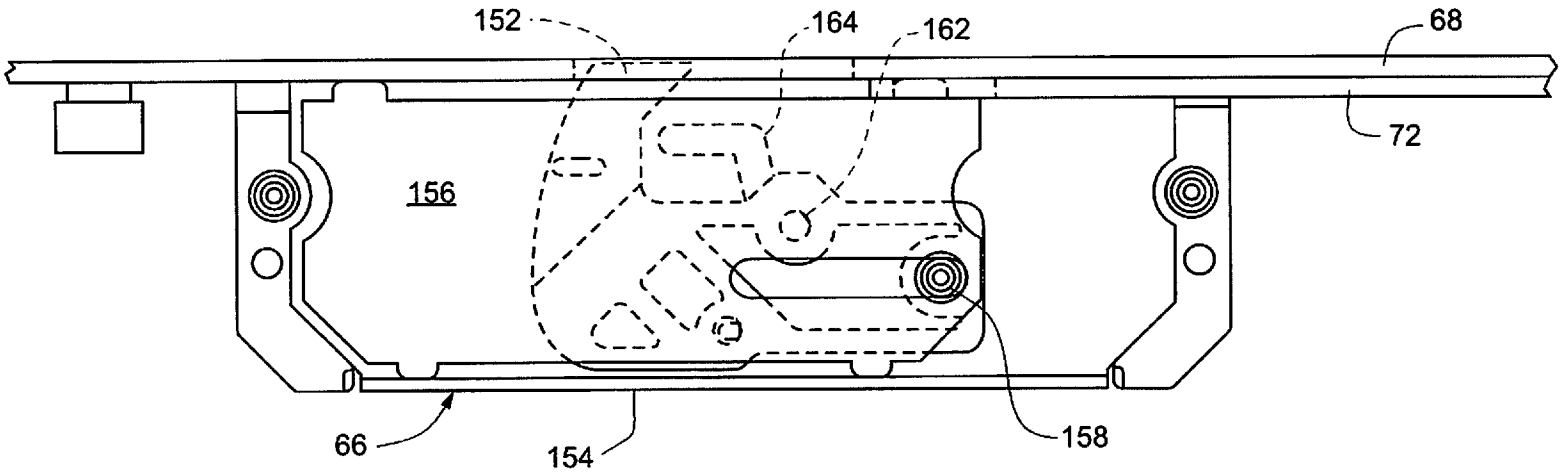
Figure 12:
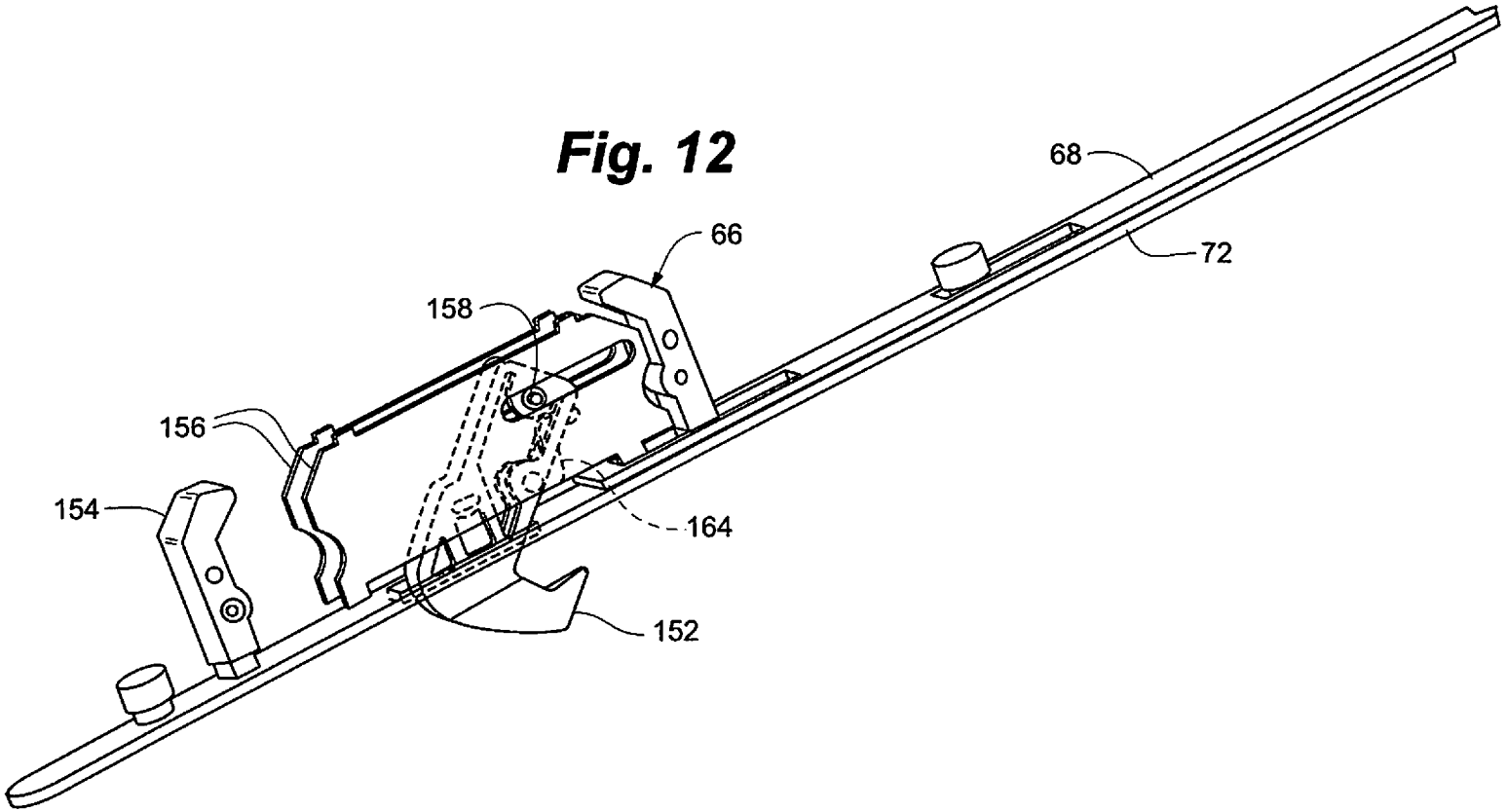
FIG. 12 is a perspective view of the remote locking mechanism of FIG. 10 in an embodiment of the invention.

Referring to FIGS. 10 through 12, the remote locking mechanisms are depicted in an embodiment of the invention. In one embodiment, the remote locking mechanisms 66 and 76 each include a latch hook 152 that extends from a remote lock housing 154 and are actuated by the operation bar 108, which can be a single piece. Alternatively, a tongue version of the remote locking mechanism can be implemented.

The remote lock housing 154 includes two slider plates 156, one on each side of the latch hook 152. Each remote locking mechanism 66, 76 is driven by the respective tie bar 72 or 82. The tie bar 72, 82 the drives two slider plates 156 inside the remote lock housing 154, one on either side of the latch hook 152. The latch hook 152 is pivotally mounted to a remote lock shaft 158 that is rigidly connected to the remote lock housing 154. In one embodiment, a guide pin 162 extends laterally from both sides of the latch hook 152, with the ends of the guide pin 162 engaging mirrored Z-shaped slots 164 formed on the slider plates 156. As the tie bar 72, 82 drives the slider plates 156 parallel to the latch hook 152, the guide pin 162 follows the Z-shaped slots 164 in the slider plates 156 and rotates the latch hook 152 to engage or disengage the strike plate 48 on the interior member 32 of the door frame 26.

The Z-shaped slots 164 in the slider plates 156 enable over-travel of the tie bars 72 and 82 to accommodate tolerance variation in all of the components while still accurately controlling the extended and retracted positions of the latch hook 152. This aspect is advantageous when using a one-piece operation bar 108, as it helps ensure that the remote locking mechanisms 66 and 76 fully extend and retract without one remote lock preventing the other remote lock from fully extending or retracting by reaching the end of travel ahead of the other. By this design, use of a one-piece operation bar 108 is facilitated, rather than the two-piece operation bar design seen in existing patio door hardware.

References to relative terms such as upper and lower, front and back, left and right, or the like, are intended for convenience of description and are not contemplated to limit the invention, or its components, to any specific orientation. All dimensions depicted in the figures may vary with a potential design and the intended use of a specific embodiment of this invention without departing from the scope thereof.

Each of the additional figures and methods disclosed herein may be used separately, or in conjunction with other features and methods, to provide improved devices, systems and methods for making and using the same. Therefore, combinations of features and methods disclosed herein may not be necessary to practice the invention in its broadest sense and are instead disclosed merely to particularly describe representative embodiments of the invention.

For purposes of interpreting the claims for the present invention, it is expressly intended that the provisions of 35 U.S.C. §112(f) are not to be invoked unless the specific terms "means for" or "step for" are recited in the subject claim.

The invention claimed is:

1. A hinged door system for closing an opening in a structure, the system comprising:

a frame defining a primary door opening and a sidelight opening adjacent the primary door opening;

a first primary hinged panel operably disposed in the primary door opening, and a secondary hinged panel operably disposed in the sidelight opening;

a multi-point latching system on the secondary hinged panel, the multi-point latching system comprising:

a center cassette having an operating mechanism and a selectively retractable latch bolt operable with the operating mechanism;

at least one remote latch mechanism spaced apart from the center cassette, the at least one remote latch mechanism including a selectively operable latch bolt;

a coupler linking the at least one remote latch mechanism with the operating mechanism of the center cassette; and a rotatable lever handle operably coupled with the operating mechanism of the center cassette such that when the handle is positioned in a first position, the latch bolt of the center cassette and the latch bolt of the at least one remote latch mechanism are extended to latch the secondary hinged panel in place in the sidelight opening, when the handle is rotated to a second position in a single direction of rotation, the latch bolt of the at least one remote latch mechanism is retracted and the latch bolt of the center cassette remains extended, and when the handle is rotated to a third position in the single direction of rotation, both the latch bolts of the center cassette and the at least one remote latch mechanism are retracted to enable the secondary panel to be opened.

2. The hinged door system of claim 1, wherein the second position of the handle is a first angular distance from the first position, and the third position is a second angular distance from the first position, the second angular distance being greater than the first angular distance.

3. The hinged door system of claim 2, wherein the first angular distance is 70 degrees.

4. The hinged door system of claim 2, wherein the second angular distance is 90 degrees.

5. The hinged door system of claim 1, wherein the multi-point latching system comprises two remote latch mechanisms.

6. The hinged door system of claim 5, wherein the center cassette and the two remote latching mechanisms are disposed along a side margin of the secondary hinged panel opposite a pair of hinges disposed along an opposing side margin of the secondary hinged panel.

7. The hinged door system of claim 6, wherein one of the remote latching mechanisms is disposed vertically above the center cassette and the other of the remote latching mechanism is disposed vertically below the center cassette.

8. The hinged door system of claim 1, wherein the latch bolt of the center cassette is spring-loaded.

9. A multi-point latching system comprising:

a center cassette having an operating mechanism and a selectively retractable latch bolt operable with the operating mechanism;

at least one remote latch mechanism spaced apart from the center cassette, the at least one remote latch mechanism including a selectively operable latch bolt;

a coupler linking the at least one remote latch mechanism with the operating mechanism of the center cassette; and a rotatable lever handle operably coupled with the operating mechanism of the center cassette such that when the handle is positioned in a first position, the latch bolt of the center cassette and the latch bolt of the at least one remote latch mechanism are extended to latch the secondary hinged panel in place in the sidelight opening, when the handle is rotated to a second position in a single direction of rotation, the latch bolt of the at least one remote latch mechanism is retracted and the latch bolt of the center cassette remains extended, and when the handle is rotated to a third position in the single direction of rotation, both the latch bolts of the center cassette and the at least one remote latch mechanism are retracted to enable the secondary panel to be opened.

10. The multi-point latching system of claim 9, wherein the second position of the handle is a first angular distance from the first position, and the third position is a second angular distance from the first position, the second angular distance being greater than the first angular distance.

11. The multi-point latching system of claim 10, wherein the first angular distance is 70 degrees.

12. The multi-point latching system of claim 10 wherein the second angular distance is 90 degrees.

13. The multi-point latching system of claim 9, wherein the multi-point latching system comprises two remote latch mechanisms.

14. The multi-point latching system of claim 13, wherein the center cassette and the two remote latching mechanisms are disposed along a side margin of the secondary hinged panel opposite a pair of hinges disposed along an opposing side margin of the secondary hinged panel.

15. The multi-point latching system of claim 14, wherein one of the remote latching mechanisms is disposed vertically above the center cassette and the other of the remote latching mechanism is disposed vertically below the center cassette.

16. The multi-point latching system of claim 9, wherein the latch bolt of the center cassette is spring-loaded.

* * * * *

UNITED STATES PATENT AND TRADEMARK OFFICE

CERTIFICATE OF CORRECTION

PATENT NO. : 8,850,744 B2
APPLICATION NO. : 13/842494
DATED : October 7, 2014
INVENTOR(S) : Leonard P. Bauman et al.

It is certified that error appears in the above-identified patent and that said Letters Patent is hereby corrected as shown below:

Page 2, (56) US Patent Document, Column 2:
Delete "2005/0092042 A1* 5/2005 Constantinou et al. 70/107" and insert --2005/0092042 A1* 5/2005 Constantinou et al. 070/107--

Page 2, (56) US Patent Document, Column 2:
Delete "2005/0166647 A1* 8/2005 Walls et al. 70/107" and insert --2005/0166647 A1* 8/2005 Walls et al. 070/107--

Page 2, (56) US Patent Document, Column 2:
Delete "2006/0196236 A1* 9/2006 Gruenendahl 70/107" and insert --2006/1096236 A1* 9/2006 Gruenendahl 070/107--

Signed and Sealed this
Fifth Day of April, 2016

Michelle K. Lee

Michelle K. Lee
*Director of the United States Patent and Trademark Office*